US010380821B2

(12) United States Patent
Li et al.

(10) Patent No.: US 10,380,821 B2
(45) Date of Patent: Aug. 13, 2019

(54) TEMPORARY PAPER MONEY STORAGE DEVICE

(71) Applicant: GRG BANKING EQUIPMENT CO., LTD., Guangzhou, Guangdong (CN)

(72) Inventors: Zhimin Li, Guangdong (CN); Huan Xu, Guangdong (CN); Zhe Li, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 154 days.

(21) Appl. No.: 15/527,903

(22) PCT Filed: Jul. 30, 2015

(86) PCT No.: PCT/CN2015/085516
§ 371 (c)(1),
(2) Date: May 18, 2017

(87) PCT Pub. No.: WO2016/145761
PCT Pub. Date: Sep. 22, 2016

(65) Prior Publication Data

US 2018/0350181 A1 Dec. 6, 2018

(30) Foreign Application Priority Data

Mar. 17, 2015 (CN) ..... 2015 1 0117691

(51) Int. Cl.
*G07D 11/175* (2019.01)
*G07D 11/14* (2019.01)
(Continued)

(52) U.S. Cl.
CPC ..... *G07D 11/175* (2019.01); *B65H 29/006* (2013.01); *B65H 29/52* (2013.01);
(Continued)

(58) Field of Classification Search
CPC ..... G07D 11/003; G07D 11/0018; G07D 11/0021; B65H 29/006; B65H 29/52;
(Continued)

(56) References Cited

U.S. PATENT DOCUMENTS 4,513,880 A 4/1985 Mori et al.
8,215,579 B2 * 7/2012 Mizoro ..... B65H 29/006 242/528
(Continued)

FOREIGN PATENT DOCUMENTS

CN 1314298 A 9/2001
CN 101353120 A 1/2009
(Continued)

OTHER PUBLICATIONS

International Search Report for PCT/CN2015/085516, dated Dec. 28, 2015, ISA/CN.

*Primary Examiner* — Mark J Beauchaine
(74) *Attorney, Agent, or Firm* — Yue (Robert) Xu; Apex Attorneys at Law, LLP

(57) ABSTRACT

The banknote temporary storage device includes: a pair of coiling tapes, a large coiling block, an upper and lower coiling block assemblies, and a banknote inlet/outlet. Each of the pair of coiling tapes has one end fixed on the large coiling block and another end, and the another ends of the pair of coiling tapes are respectively fixed to the upper coiling block assembly and the lower coiling block assembly. The banknote inlet/outlet includes an upper clamping roller and a lower clamping roller. The large coiling block is provided with a lower passage guide plate having one end rotatably arranged on the lower rotating shaft and a relatively free end, a tail portion of the free end is an arc-shaped portion concentric with the large coiling block, and an angle
(Continued)

by which the arc-shaped portion surrounds the large coiling block ranges from 40 degrees to 50 degrees.

3 Claims, 3 Drawing Sheets

(51) Int. Cl.

| | |
|---|---|
| ***G07D 11/16*** | (2019.01) |
| ***G07D 11/00*** | (2019.01) |
| ***B65H 29/00*** | (2006.01) |
| ***B65H 29/52*** | (2006.01) |

(52) U.S. Cl.
CPC ..... *G07D 11/00* (2013.01); *G07D 11/14* (2019.01); *G07D 11/16* (2019.01); *B65H 2301/41912* (2013.01); *B65H 2301/41924* (2013.01); *B65H 2404/1114* (2013.01); *B65H 2404/1521* (2013.01); *B65H 2404/612* (2013.01); *B65H 2404/63* (2013.01); *B65H 2701/1912* (2013.01); *G07D 2211/00* (2013.01)

(58) Field of Classification Search
CPC ..... B65H 2404/1114; B65H 2211/00; B65H 2701/1912; B65H 2301/41924
See application file for complete search history.

(56) References Cited

U.S. PATENT DOCUMENTS

| | | | | |
|---|---|---|---|---|
| 2001/0022258 | A1* | 9/2001 | Satou ..... | B65H 29/006 194/206 |
| 2010/0163571 | A1 | 7/2010 | Mizoro | |
| 2015/0307300 | A1 | 10/2015 | Xu et al. | |

FOREIGN PATENT DOCUMENTS

| | | | |
|---|---|---|---|
| CN | 101828204 | A | 9/2010 |
| CN | 102044109 | A | 5/2011 |
| CN | 102700983 | A | 10/2012 |
| CN | 102730464 | A | 10/2012 |
| CN | 102963782 | A | 3/2013 |
| CN | 103979353 | A | 8/2014 |
| CN | 104773588 | A | 7/2015 |
| JP | 2000123219 | A | 4/2000 |
| JP | 2006069708 | A | 3/2006 |

* cited by examiner

TEMPORARY PAPER MONEY STORAGE DEVICE

This application is the national phase of International Application No. PCT/CN2015/085516, titled "TEMPORARY PAPER MONEY STORAGE DEVICE", filed on Jul. 30, 2015, which claims the benefit of priority to Chinese patent application No. 201510117691.8, titled "BANKNOTE TEMPORARY STORAGE DEVICE", filed with the Chinese State Intellectual Property Office on Mar. 17, 2015, the entire disclosures of which are incorporated herein by reference.

FIELD

This application relates to the technology for processing sheet-like mediums, and particularly to a banknote temporary storage device in financial equipment for temporarily receiving and discharging banknotes.

BACKGROUND

Currently widely used banknote processing apparatuses are classified into automatic teller machines, automatic banknote deposit machines, automatic banknote recycling system and the like according to main functions. The main functions of these banknote processing apparatuses include basic self-service financial transactions such as banknote withdrawing, banknote depositing and transferring and the like. In a conventional banknote processing apparatus, for both the banknote depositing process and the banknote withdrawing process, a certain amount of banknotes to be processed are required to be temporarily stored after they have been processed, and till the transactions are confirmed, the corresponding depositing and withdrawing processes are then accomplished. The temporary storage device for temporarily storing banknotes is required to receive and discharge banknotes individually.

In a conventional banknote temporary storage device, banknotes are fed into the banknote temporary storage device in a direction along short sides of the banknotes and then are wound on a large coiling block together with coiling tapes. The banknotes are stacked in layers on the large coiling block, which makes the outer diameter of the large coiling block gradually increase, thereby realizing the temporary storage function. Conversely, the banknotes wound on the large coiling block can be discharged into a paper conveying passage individually through the reversing rotation of the coiling tapes and the large coiling block.

The banknote storage mechanism having such features may not be easily affected by the difference in widths of the banknotes. To prevent an oversized rotational inertia from being applied on the wheel of the coiling tapes, widths of the coiling tapes should be within a certain range. In addition, in the case that more than two pairs of the coiling tapes are used, the large coiling block may have inconsistent outer diameter after the banknotes are reeled up onto the large coiling block, which is highly possible to lead to warp of the banknotes; and thus it is preferably to use one pair of the coiling tapes.

However, since only one pair of thin coiling tapes is located at the central position of the large coiling block, the coverage of the coiling tapes for the banknotes is limited. Because of the limitation of the outer diameter of the large coiling block wrapped with the banknotes, an effective confined space is difficult to be formed between a rotation shaft of the large coiling block and an outer clamping roller of the coiling tapes, and a corner of the discharged banknote may tilt upward to form a triangular folded corner. Further, in the process of separating a banknote from the large coiling block, if a front end of the banknote being separated and discharged has a slit, the front end of the banknote often impacts a lower passage plate of the coiling block at a position where the banknote is in contact with the lower passage plate and thus the front end of the banknote would be folded, resulting in that the banknote is jammed or torn in the subsequent conveying process in the passage. In view of this problem, in the bulletin of the Chinese Patent Application Publication No. CN1314298A (Application No. 01101724.4), a structure is provided, which includes a wheel for winding the coiling tape together with banknotes and provided at the center of a conveying passage, and a reel for winding the coiling tape sent out from the wheel, and further includes a guide device. As described in an example of the bulletin, a deformation roller in contact with the large coiling block presses the banknotes into wave shape to reduce the risk of forming folded corners. However for the banknotes having slits outside the deformation roller, the wave shape of the banknotes can only be formed in the action range of the deformation roller and cannot be formed in the slit area, thus the banknotes are still apt to form triangle folded corners.

Therefore it is necessary to solve the problem that the banknotes may form folded corners in the banknote temporary storage device.

SUMMARY

To prevent a situation that a banknote is folded or torn caused by four corners of the banknote tilting upward or a torn part of the banknote titling in the process of conveying the banknote in a direction along its short side, and in which case, the normal operation of a banknote temporary storage device is adversely affected, a banknote temporary storage device is provided according to the present application, which effectively reduces the occurrence of folded corners or tear of banknotes, and thus improving the operation reliability of the device.

The banknote temporary storage device includes: a pair of coiling tapes, a large coiling block, an upper coiling block assembly and a lower coiling block assembly, and a banknote inlet/outlet. The pair of coiling tapes is configured to clamp banknotes to be temporarily stored. Each of the pair of coiling tapes has one end fixed on the large coiling block, and the large coiling block is configured to temporarily store the banknotes by accommodating the coiling tapes which clamp the banknotes to be temporarily stored. Each of the pair of coiling tapes has another end, and the another ends of the pair of coiling tapes are respectively fixed to the upper coiling block assembly and the lower coiling block assembly, and the upper coiling block assembly and the lower coiling block assembly are configured to release or wind the coiling tapes simultaneously according to a requirement of temporarily storing or discharging the banknotes. The banknote inlet/outlet includes a pair of clamping rollers engaging with each other, the pair of clamping rollers engaging with each other includes an upper clamping roller arranged on an upper rotating shaft and a lower clamping roller arranged on a lower rotating shaft. The large coiling block is provided with a lower passage guide plate, the lower passage guide plate has one end rotatably arranged on the lower rotating shaft and another end being drew by a spring to form a relatively free end elastically urged towards the large coiling block, a tail portion of the free end is an arc-shaped portion concentric with the large coiling block, and an angle by which the arc-shaped portion surrounds the large coiling block ranges from 40 degrees to 50 degrees.

Preferably, a rolling wheel is provided at a middle of the lower passage guide plate by a first rotating shaft, and the rolling wheel is in rolling contact with an outer surface of the large coiling block or an outer surface of a banknote wound on the large coiling block.

Further, the rolling wheel has a radius ranging from 8 mm to 14 mm.

Preferably, a vane wheel configured to flap the banknotes is provided at the free end of the lower passage plate by a second rotating shaft, and the first rotating shaft and the second rotating shaft are configured to synchronously rotate by means of a synchronous belt.

Preferably, the number of the vane wheel is two, and the two vane wheels are respectively located at two sides of the coiling tapes, and are configured to flap portions of the banknotes at the two sides of the coiling tapes.

Compared with the conventional technology, the banknote temporary storage device according to the present application has the following technical effects.

In the banknote temporary storage device, the tail portion of the free end of the lower passage plate has a shape concentric with the large coiling block, and the tail portion of the free end surrounds the large coiling block by an angle ranging from 40 degrees to 50 degrees, and with the provision of the rolling wheel having a radius ranging from 8 mm to 14 mm on the lower passage plate, when a banknote having a slit enters the coiling block to be temporarily stored, an impact angle, at which a cracked edge of a banknote tilting upwards impacts the passage plate of the coiling block, is configured to be less than 40 degrees as much as possible, the cracked edge of the banknote may be at an acute angle with respect to the surface of the passage plate and thus would slide down along the surface of the passage plate, so that the cracked edge tilting upwards would be restrained and corrected, which avoids the situation that the slit is widened and even a folded corner is formed.

DETAILED DESCRIPTION

The banknote temporary storage device according to the present application will be clearly and completely described hereinafter in conjunction with the drawings.

Figure 1:
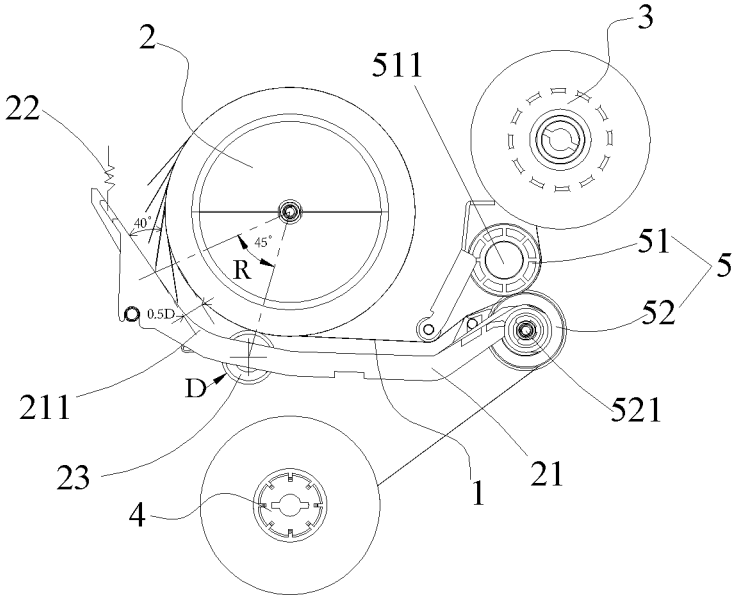
FIG. 1 is a partial side view of a banknote temporary storage device according to a preferred embodiment of the present application.

Referring to FIG. 1, the banknote temporary storage device includes: a pair of coiling tapes 1, a large coiling block 2, an upper coiling block assembly 3, a lower coiling block assembly 4 and a banknote inlet/outlet 5. The pair of coiling tapes 1 is configured to clamp banknotes to be temporarily stored. Each of the pair of coiling tapes 1 has one end fixed on the large coiling block 2, the large coiling block 2 is configured to temporarily store the banknotes by accommodating the coiling tapes which clamp the banknotes to be temporarily stored, and the large coiling block is driven by a motor (not shown in the drawings) to rotate. Each of the pair of coiling tapes 1 has another end, and the another ends of the pair of coiling tapes 1 are fixed on the upper coiling block assembly 3 and the lower coiling block assembly 4 respectively, and the upper coiling block assembly 3 and the lower coiling block assembly 4 are configured to release or wind the coiling tapes 1 simultaneously depending on the requirement for temporarily storing or discharging the banknotes, and a driving source is provided for the upper coiling block assembly 3 and the lower coiling block assembly 4. The banknote inlet/outlet 5 includes a pair of clamping rollers 51, 52 engaging with each other, the pair of engaged clamping rollers 51, 52 includes an upper clamping roller 51 arranged on an upper rotating shaft 511 and a lower clamping roller 52 arranged on a lower rotating shaft 521. The large coiling block 2 is provided with a lower passage guide plate 21, and the lower passage guide plate 21 has one end rotatably arranged on the lower rotating shaft 521, and another end being drew by a spring 22 to form a relatively free end elastically urged towards the large coiling block 2. A tail portion of the free end is an arc-shaped portion 211 concentric with the large coiling block 2, and an angle by which the arc-shaped portion 211 surrounds the large coiling block 2 is 45 degrees.

Figure 5:
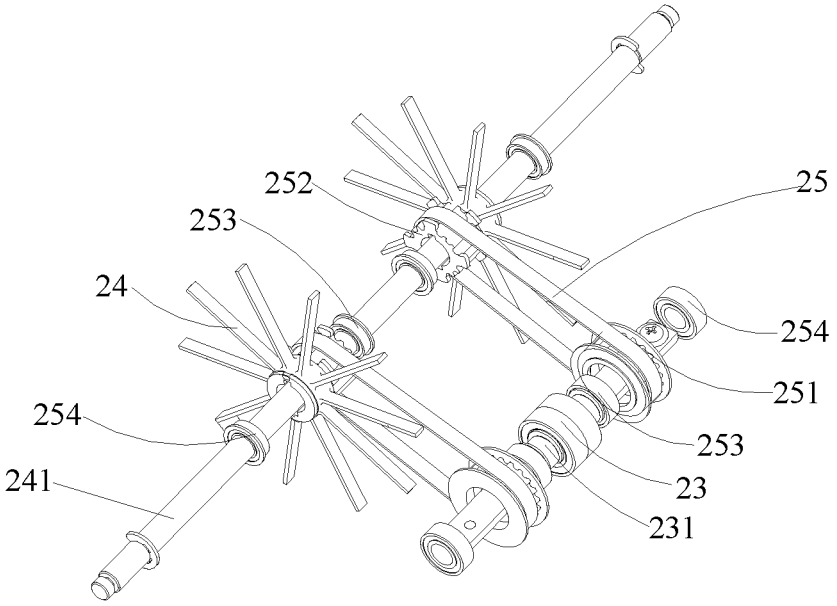
FIG. 5 is a schematic view showing the composition of a vane wheel and a rolling wheel in the banknote temporary storage device shown in FIG. 2.

To ensure that a banknote having a slit can be smoothly accommodated and discharged, as shown in FIG. 5, a rolling wheel 23 is provided at the middle of the lower passage guide plate 21 by a first rotating shaft 231. The rolling wheel 23 is in rolling contact with an outer surface of the large coiling block 2 or an outer surface of the banknote wound and stored on the large coiling block, and the rolling wheel has a radius D of 11 mm. A tail portion of the lower passage plate 21 of the large coiling block 2 is designed to have an arc shape. Since a common banknote has a certain depth and rigidity, in the case that an impact angle R, at which a cracked edge of a banknote tilting upwards impacts the lower passage plate 21, is less than 40 degrees as much as possible, the cracked edge of the banknote may be at an acute angle with respect to the surface of the lower passage plate and thus would slide down along the surface of the lower passage plate, so that the cracked edge tilting upwards would be restrained and corrected, which avoids the situation that the slit is widened and even a folded corner is formed.

Figure 2:
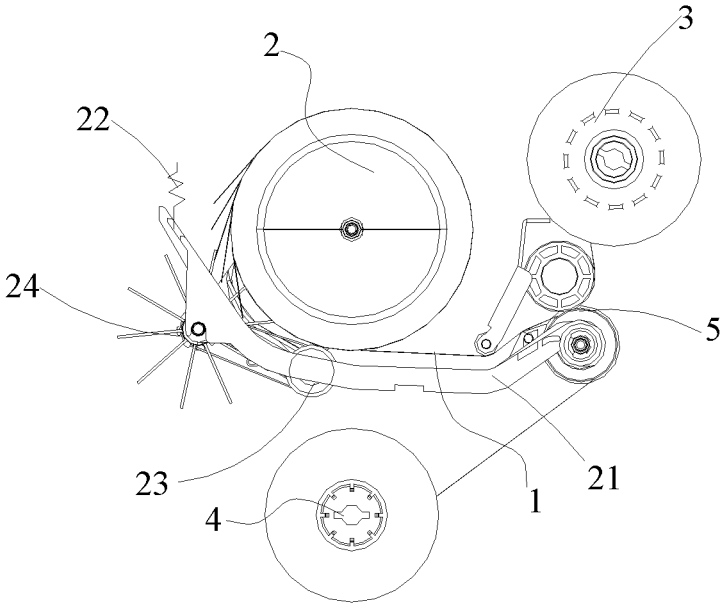
FIG. 2 is a partial side view of a banknote temporary storage device according to another preferred embodiment of the present application.
Figure 3:
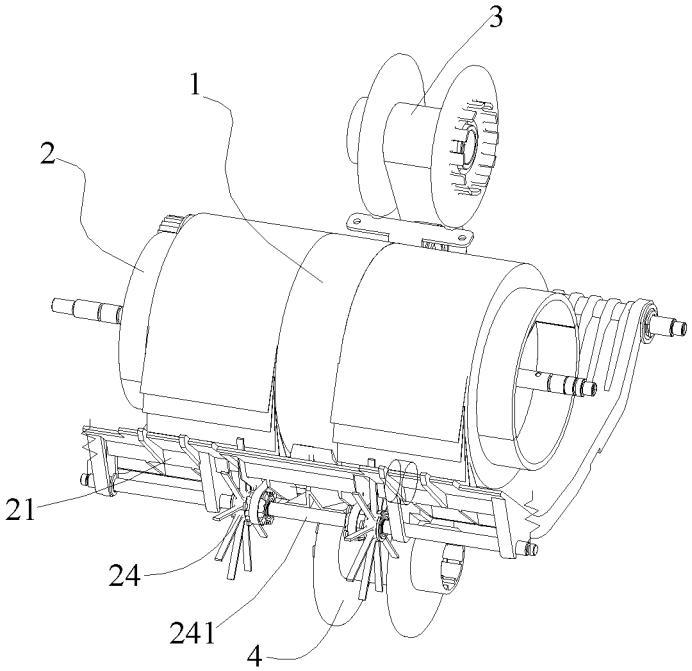
FIG. 3 is a first schematic view of the banknote temporary storage device shown in FIG. 2 in a banknote temporary storing state.
Figure 4:
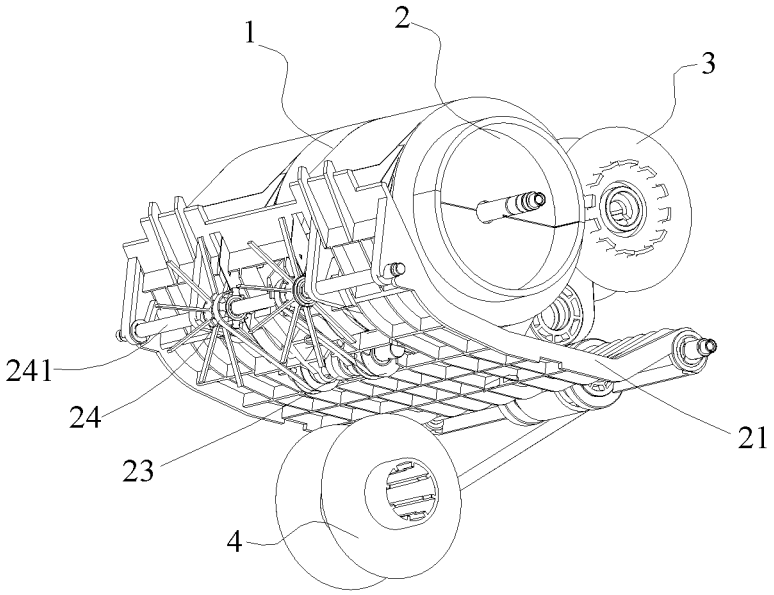
FIG. 4 is a second schematic view of the banknote temporary storage device shown in FIG. 2 in the banknote temporary storing state.

To ensure that a banknote having a large slit can be smoothly accommodated and discharged, another preferred embodiment is further provided according to the present application. Referring to FIGS. 2, 3 and 4, a vane wheel 24 configured to flap banknotes is provided at the free end of the lower passage plate 21 by a second rotating shaft 241. The first rotating shaft 231 and the second rotating shaft 241 can synchronously rotate by means of a synchronous belt 25. Two vane wheels 24 are provided, which are respectively located at two sides of the coiling tapes 1 and are configured for flapping portions of the banknotes at the two sides of the coiling tapes 1.

Referring to FIG. 5, each of the synchronous belts 25 between the first rotating shaft 231 and the second rotating shaft 241 is installed on the first rotating shaft 231 and the second rotating shaft 241 by means of synchronous pulleys 251 and 252 respectively. The synchronous pulleys 251 and 252 are assembled with the rotating shafts through bearings 253 respectively. The first rotating shaft 231 and the second rotating shaft 241 are assembled with the lower passage plate through bearings 254.

Referring to FIGS. 4 and 5, the banknotes would always fit against the synchronous pulley 251 under the action of the spring 22 when the banknotes are wound on the large coiling block 2. The banknotes are tensioned by the coiling tape 1 at the center of the large coiling block 2, and the banknotes are pressed by two lateral edges of the two synchronous pulleys 251, thus ensuring that the two sides of the banknotes in the length direction of the banknotes would not tilt upward when the banknotes are counted and thus the banknotes can be smoothly conveyed.

As shown in FIG. 5, the banknotes on the large coiling block 2 would be in contact with the synchronous pulleys 251 in the conveying process, and thus the synchronous pulleys 251 are driven to rotate clockwise or counterclockwise. A bearing 253 is arranged inside each of the synchronous pulleys 251, thus, the synchronous pulley 251 can rotate smoothly and independently. The synchronous belts 25 are provided between the first rotating shaft 231 and the second rotating shaft 241, thus, the power of the synchronous pulleys 251 can be transmitted to the synchronous pulleys 252. A bearing 253 is also arranged inside each of the synchronous pulleys 252, thus the synchronous pulley 252 can rotate smoothly and independently. Further, the vane wheel 24 is fixed to another side of the pulley 252, thus the vane wheel 24 may be driven synchronously.

When banknotes are released from the large coiling block 2 in a counterclockwise direction, the synchronous pulleys 251 rotate clockwise. The vane wheels 24 are driven by the synchronous belts 25 to rotate clockwise as well, to realize the function of flapping the banknotes at the tail portion of the lower passage plate 21, and thus an upwardly tilting folded corner of a banknote having a slit can be flapped down by the vane wheels 24 before the folded corner comes into contact with the lower passage plate 21, and thus the banknotes can always fit closely against the lower passage plate 21. Similarly, when banknotes enter the rolling block in a clockwise direction, the synchronous pulleys 251 rotate counterclockwise. The vane wheels 24 are driven by the synchronous belts 25 to rotate counterclockwise as well, to realize the function of flapping the banknotes at the tail portion of the lower passage plate 21, and thus an upwardly tilting folded corner of a banknote having a slit can be flapped down by the vane wheels 24 before the folded corner comes into contact with the lower passage plate 21, and thus the banknotes can fit closely against the lower passage plate 21.

As shown in FIG. 4, the vane wheels 24 are arranged at the two sides of banknotes in the length direction of the banknotes and at the two sides of the coiling tapes 1 close to the coiling tapes. Therefore, common upwardly tilted banknotes with a slit would be restrained and improved significantly.

The above description is only specific embodiments of the present application, and the scope of protection of the present application is not limited to this. Modifications or substitutions may be easily conceived by the person skilled in the art within the technical scope disclosed by the present application; and these modifications or substitutions fall into the scope of protection of the present application. Therefore, the scope of protection of the present application should be defined by the claims.

The invention claimed is:

1. A banknote temporary storage device, comprising:

a pair of coiling tapes configured to clamp banknotes to be temporarily stored;

a large coiling block, wherein each of the pair of coiling tapes has one end fixed on the large coiling block, and the large coiling block is configured to temporarily store the banknotes by accommodating the coiling tapes which clamp the banknotes to be temporarily stored;

an upper coiling block assembly and a lower coiling block assembly, wherein each of the pair of coiling tapes has another end, and the another ends of the pair of coiling tapes are respectively fixed to the upper coiling block assembly and the lower coiling block assembly, and the upper coiling block assembly and the lower coiling block assembly are configured to release or wind the coiling tapes simultaneously according to a requirement of temporarily storing or discharging the banknotes; and a banknote inlet/outlet comprising a pair of clamping rollers engaging with each other, wherein the pair of clamping rollers engaging with each other comprise an upper clamping roller arranged on an upper rotating shaft and a lower clamping roller arranged on a lower rotating shaft, and wherein the large coiling block is provided with a lower passage guide plate, the lower passage guide plate has one end rotatably arranged on the lower rotating shaft and another end being drawn by a spring to form a relatively free end elastically urged towards the large coiling block, a tail portion of the free end is an arc-shaped portion concentric with the large coiling block, and an angle by which the arc-shaped portion surrounds the large coiling block ranges from 40 degrees to 50 degrees, wherein a rolling wheel is provided at a middle of the lower passage guide plate by a first rotating shaft, and the rolling wheel is in rolling contact with an outer surface of the large coiling block or an outer surface of a banknote wound on the large coiling block, wherein a vane wheel configured to flap the banknotes is provided at the free end of the lower passage plate by a second rotating shaft, and the first rotating shaft and the second rotating shaft are configured to synchronously rotate by means of a synchronous belt.

2. The banknote temporary storage device according to claim 1, wherein the rolling wheel has a radius ranging from 8 mm to 14 mm.

3. The banknote temporary storage device according to claim 1, wherein the number of the vane wheel is two, and the two vane wheels are respectively located at two sides of the coiling tapes, and are configured to flap portions of the banknotes at the two sides of the coiling tapes.

* * * * *